United States Patent [19]

Ferri

[11] Patent Number: 4,890,404

[45] Date of Patent: Jan. 2, 1990

[54] MAGAZINE FOR STRIP AMMUNITION, WITH RECTANGULAR PRISMATIC HOUSING AND SLIDING EXTRACTION DETENT

[76] Inventor: Giampiero Ferri, Via Vecchia Fiesolana No. 74 S. Domenico Fraz. com. di Fiesole, Florence, Italy

[21] Appl. No.: 203,011

[22] Filed: Jun. 6, 1988

[30] Foreign Application Priority Data

Jun. 11, 1987 [IT] Italy ..... 9409 A/87

[51] Int. Cl.[4] ..... F41B 7/08

[52] U.S. Cl. ..... 42/57; 124/2; 446/403

[58] Field of Search ..... 42/54, 57; 446/401, 446/403; 124/2; 89/35.01, 33.01, 33.02, 33.03, 33.1, 33.14, 33.16, 33.17

[56] References Cited

U.S. PATENT DOCUMENTS

| | | | |
|---|---|---|---|
| 545,345 | 8/1895 | Carty et al. | 42/54 |
| 924,732 | 6/1909 | Carey | 89/33.14 |
| 1,552,567 | 9/1925 | Reardon | 42/57 |
| 1,666,579 | 4/1928 | Moller et al. | 42/54 |
| 1,799,283 | 4/1931 | Coupland | 89/33.14 |
| 3,292,293 | 12/1966 | Chisera et al. | 42/57 |

FOREIGN PATENT DOCUMENTS

| | | | |
|---|---|---|---|
| 21235 | 8/1906 | Sweden | 89/33.1 |
| 64030 | 5/1913 | Switzerland | 89/33.14 |
| 449943 | 7/1936 | United Kingdom | 89/33.14 |

*Primary Examiner*—Deborah L. Kyle
*Assistant Examiner*—Michael J. Carone
*Attorney, Agent, or Firm*—Hopgood, Calimafde, Kalil, Blaustein & Judlowe

[57] ABSTRACT

The magazine is for use with strip ammunition capable of being fed by slide action into the firearm whenever the trigger is pulled; a housing accommodates a number of ammunition strips resting on top of one another, and a pressure device props the strips against a sliding surface with a discharge aperture for the strip in contact with the surface; an extraction device capable of sliding along an opening in the sliding surface is designed to push the strip in contact with the surface itself and to slide in the opposite direction without any drag effect.

14 Claims, 5 Drawing Sheets

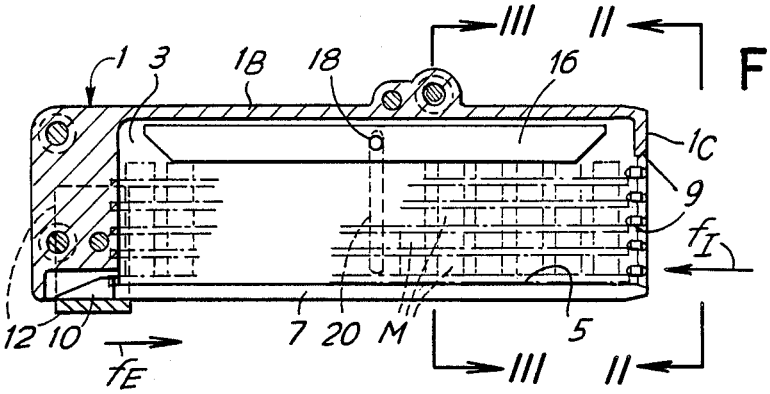
Fig.1
Fig.2
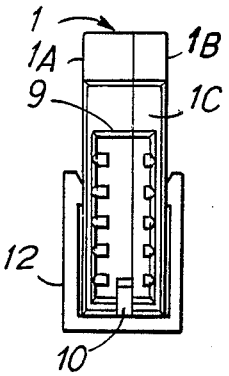
Fig.3
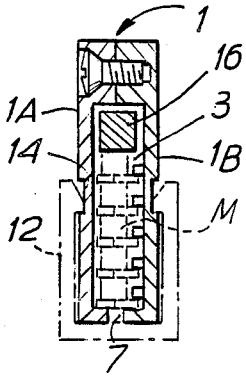
Fig.4
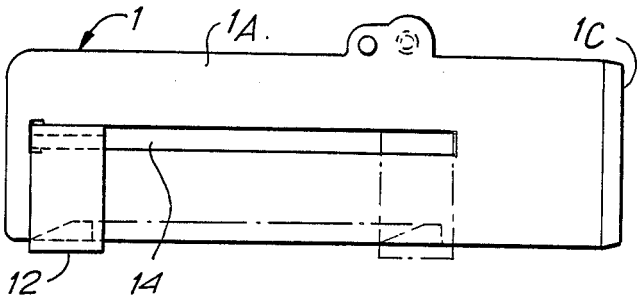
Fig.5
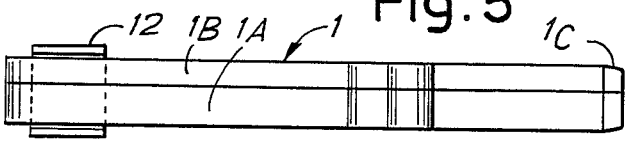

MAGAZINE FOR STRIP AMMUNITION, WITH RECTANGULAR PRISMATIC HOUSING AND SLIDING EXTRACTION DETENT

The invention concerns a magazine for toy firearms, suitable for use in several types of toy firearms, and also concerns toy firearms specially designed for using the said magazine.

According to the invention, a magazine for strip ammunition designed to be fed by slide action into the firearm whenever the trigger is pulled, comprises essentially: a housing for a number of ammunition strips resting on top of one another; in the said housing a pressure device for propping the strips against a sliding surface aligned with a discharge exit aperture for the strip in contact with the said surface; and an extraction device capable of sliding along an opening in the said sliding surface in order to push the said strip in contact with the surface itself and capable of sliding in the opposite direction without any drag effect.

The pressure device can be an elongated rod weight resting on the strips which is guided at right angles to the extension of the strips so that it is displaced device can be a flat spring or the equivalent, or can be attached to a spring.

The extraction device exhibits in practice a detent with a thrusting edge at right angles to the direction of slide, and a sloping back for the idle return run.

The magazine housing can have an end part of such a shape as makes it engageable in a firearm housing, the said end part having slots for the insertion and extraction of the ammunition strips and operating in conjunction with the bottom of the housing inside the firearm, which housing has an aperture for insertion of the ammunition strip in alignment with the said sliding surface.

The extraction device can be in the form of an externally guided and maneuverable cursor, and can be engaged resiliently in sliding groove guides in the magazine casing. Alternatively, the extraction device can be of the "pump" type, and be controlled by a rod connected to a movable part at the front of the toy firearm.

The invention also concerns a toy firearm of the automatic type, with a rear housing for accommodating a magazine as described above, and with slots corresponding with the strip to be pushed forward by the cursor, or a toy firearm of the "pump" type with a rear housing and a rod extending from the movable part at the front of the firearm for engaging and handling an extraction device in the place of a cursor.

The invention will be more readily understood if the specification is studied in conjunction with the attached drawings; these illustrate one practical embodiment of the invention, to provide a non-limitative example. In the drawings, FIGS.1, 1A and 2 and 3 represent a side view in longitudinal section, a view in accordance with the line II—II in FIG. 1, and a sectional view in accordance with the line III—III in FIG. 1, all of the magazine, here shown in isolation together with the cursor-type extraction device;

FIGS. 4 and 5 are an external side view and a view from above of the magazine depicted in FIG. 1;

Figure 8:
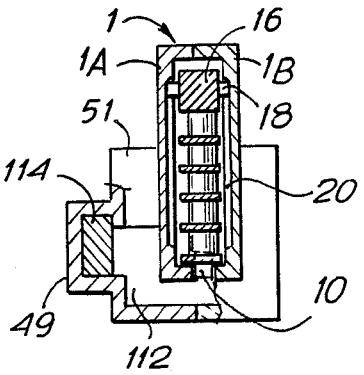
FIGS. 8 and 9 are transverse sections in accordance with the lines VIII—VIII and IX—IX in FIG. 6.
Figure 9:
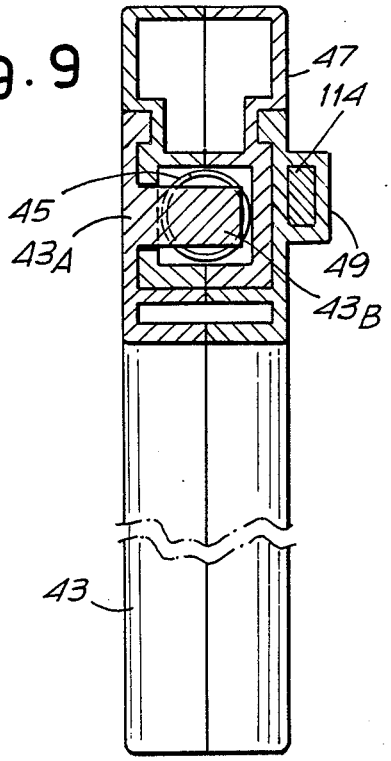

As illustrated in the attached drawings, with initial reference to FIGS. 1 to 5, the magazine according to the invention, generically indicated by the numeral 1, consists of an essentially prismatic slab-type or rectangularly shaped housing, with a large longitudinal hollow space 3 for accommodating a number or a plurality of ammunition strips M of a type that is in itself known. The housing 1 is to advantage composed of two wings or half-shells 1A, 1B joined together, and together defining a bottom sliding surface 5 traversed by an intermediate longitudinal or slotted opening 7; this emerges into a front aperture 9 corresponding with part 1C of the housing 1, which is designed to be accommodated in a housing provided for the magazine in toy firearms of the type wherein ammunition strips are fed by slide action for successive triggeroperated detonation. An extraction device slides in the opening 7 in the form of a detent 10 designed like a saw-tooth with a thrusting edge at right angles to the opening 7 and a sloping return back edge; the detent 10 is mounted on a U-shaped cursor 12 which embraces the housing 1 and is engaged so that it slides in guides 14 in the form of longitudinal recesses on the outside of the two winds or half-shells 1A, 1B forming the housing 1. The U-shaped cursor 12 can readily be resiliently inserted in the retaining and slide guides 14 through the effect of its own resilience in such a manner that the detent 10 is made to correspond with the opening 7 and to project inside the hollow space 3 emerging from the surface 5. Inside the hollow space 3 there is accommodated a pressure applying means or device in the form of a weight 16, running longitudinally, which is guided by pins 18 in grooved guides 20 in the sides of the hollow spaces 3 at right angles to the surface 5 and to the opening 7, and mostly in intermediate position of the length of the hollow space 3 (see also FIG. 8).

The strip-type ammunition M is inserted through the aperture 9, which extends so as at least to correspond to the sliding surface 5, but which may also extend over the entire front of the end coupling part 1C in the firearm, the magazine being in this case supported against the base of a housing located in the firearm to accommodate the said magazine, the base of the housing then being provided with an aperture for the insertion of the ammunition in correspondence with the sliding surface 5. The strips of ammunition M are supported against one another with the top portion thereof in contact with the pressure applying means 16 and the bottom portion thereof in contact with sliding surface 5, as shown in broken lines in FIG. 1, and are urged against the surface 5 by the weight represented by the small bar 16, which is shaped to facilitate, by a specially-designed profile, the insertion of the ammunition in the direction of the arrow $f_I$. Under the conditions of insertion, the detent 10 comes to be located in a suitable housing at the end of the opening 7, beyond the hollow space 3. The weight 16 holds back the ammunition from spontaneous sliding in the opposite direction to the arrow $f_I$, to avoid accidental discharge. The ammunition strips are discharged singly by the forward movement of detent 10 on the cursor 12, when the latter is moved in the direction of the arrow $f_E$ for the extraction process; in its operative run the detent 10 extracts the ammunition strip that is propped against the surface 5, by causing it to slide along the surface 5 from its home position and beyond the aperture 9 that is to discharge. The weight 16 keeps the strips constantly propped against the surface 5, so that after one strip has been extracted all the remaining ones become propped against the surface, so rendering another strip ready for extraction. When all the strips in the housing have been extracted, the detent 10, in making an extraction run, merely gently raises the weight 16, which is also shaped on the back by an inclined surface so as to facilitate the sliding motion of the detent 10.

Figure 1A:
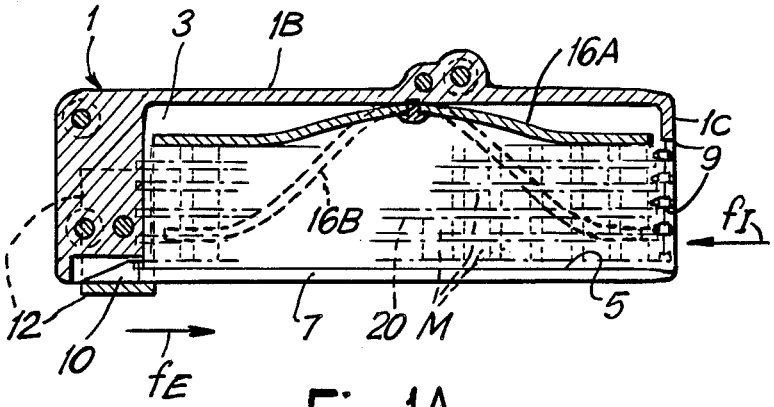
FIG. 1A is the same as FIG. 1, except that weight member 16 of FIG. 1 is replaced by flat spring member 16A.

In FIG. 1A, flat spring 16A behaves like weight member 16 of FIG. 1 in applying pressure to the strips. Thus, spring 16A is shown in the loaded position on top of the strip and in the discharge position 16B.

Figure 6:
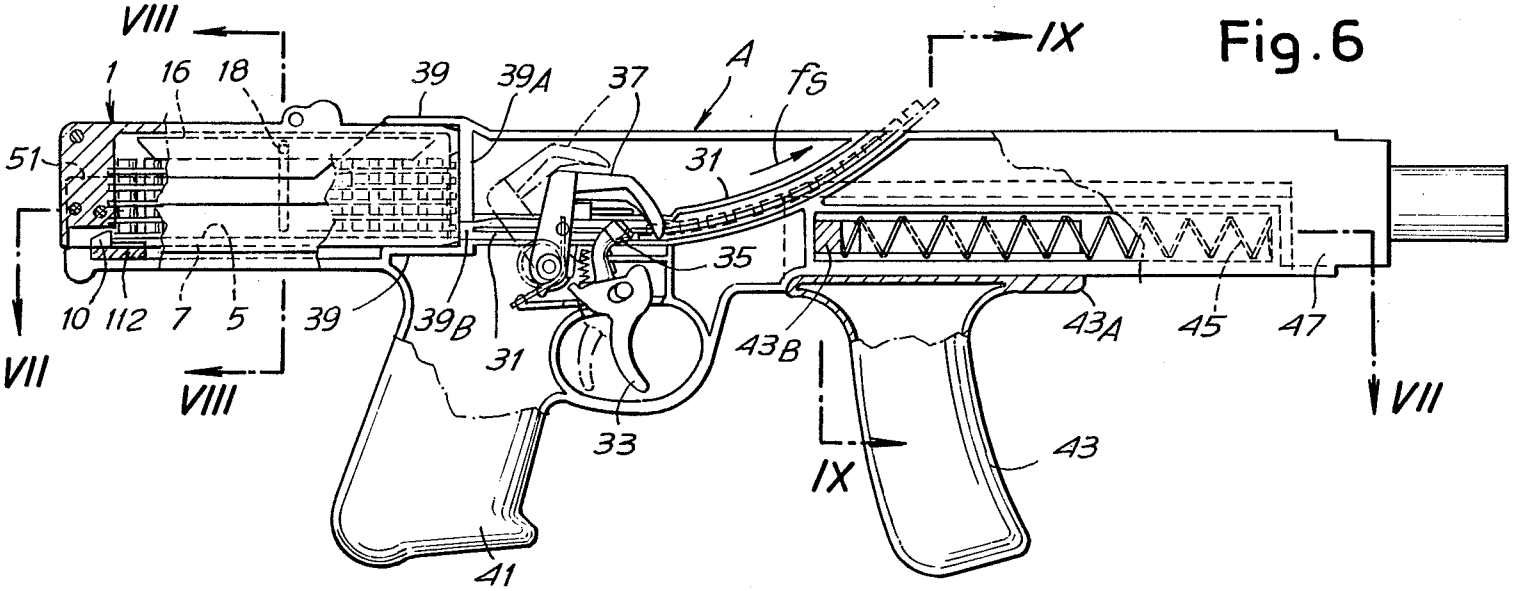
FIGS. 6 and 7 represent a magazine engaged in a toy firearm of the so-called "pump" type in a half-open side view and a longitudinal sectional view in accordance with the line VII—VII in FIG. 6.
Figure 7:
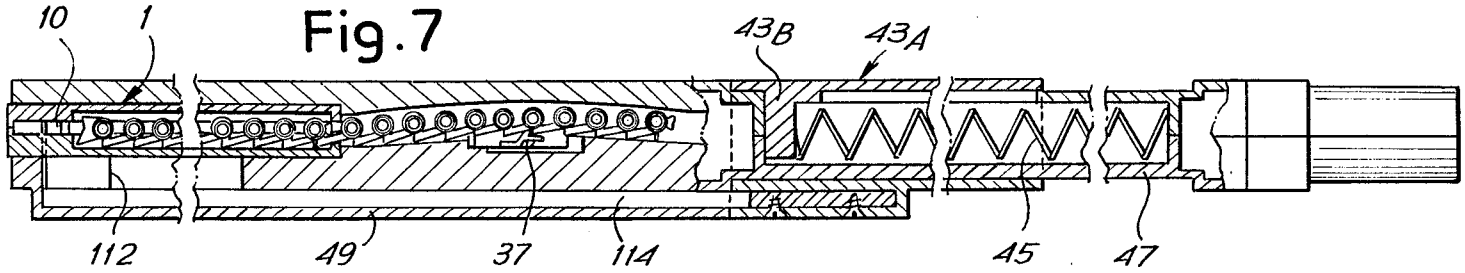

FIG. 6 depicts a firearm A of the slide-feed type, which is in itself already known, comprising a slide housing 31 for an ammunition stirp; the strip is fed inside the housing 31 in the direction of the arrow $f_5$ through action on the trigger 33, which actuates both single-step feed-in of the strip by means of a thrust device 35 and detonation of the cap by the action of a firing-pin 37. The toy firearm exhibits a housing 39 (in FIG. 6 at the rear) into which the end 1C of the magazine housing 1 is inserted in order to feed the firearm in question. The housing 39 displays at the bottom 39A an aperture 39B corresponding with the slide housing 31 and in alignment with the sliding surface 5 of the magazine. In this way a strip can be successively fed into the slide housing 31 until it is taken up by the firearm's feed mechanism.

In the version represented in FIGS. 6 to 9, the firearm is of the so-called "pump" type, and displays two grip handles 41 and 43 that can be moved closer to or further away from each other, and through this operation an ammunition strip can be fed through if this is not directly actuated by the cursor system 12. In this case the cursor 112 (identical with the one indicated by 12) is engaged by a rod 114 which is of one piece with the part 43A on which the grip handle 43 is mounted; this part 43A is urged by a spring 45 reacting on the one hand on a bracket 43B and on the other hand on the firearm casing comprising the grip handle 41 and the guides 31 belonging to he mechanism 33, 35, 37, this part being extended at the front 47. The rod 114 is guided in an elongated housing 49 formed by the main casing of the firearm. With this embodiment, moving the two grip handles 43 in relation to each other causes the cursor 112, by the action of the shaft or rod 114, to slide, together with the detent 10, so that an ammunition strip is inserted each time in the firearm's slide housing 31 until it is taken up by the thrust device 35. The housing 1 can also be accommodated in a seating 51 formed by the firearm's casing as an extension of the housing 39.

Figure 12:
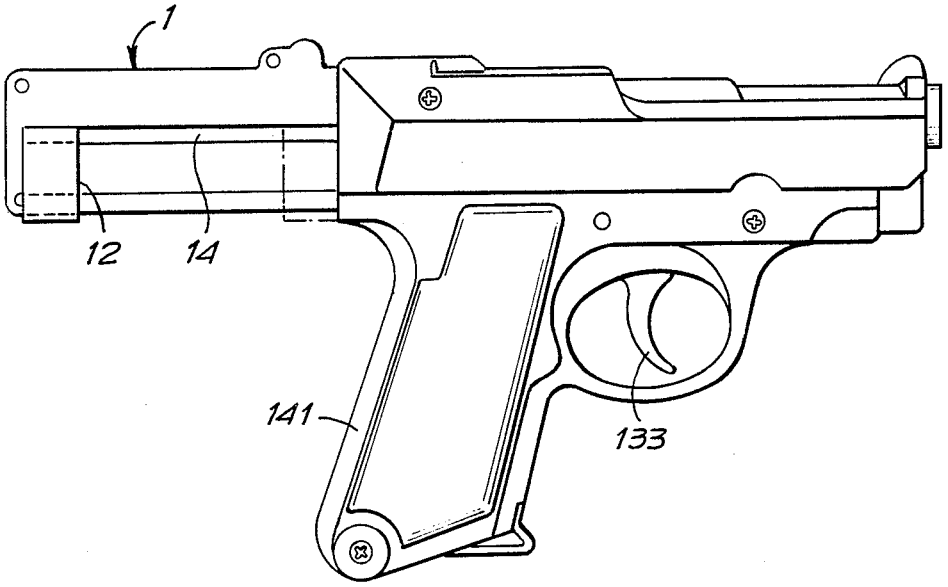
FIGS. 10, 11 and 12 represent a longitudinal sectional view, a horizontal view and a side view of a traditional toy firearm of the automatic type.
Figure 10:
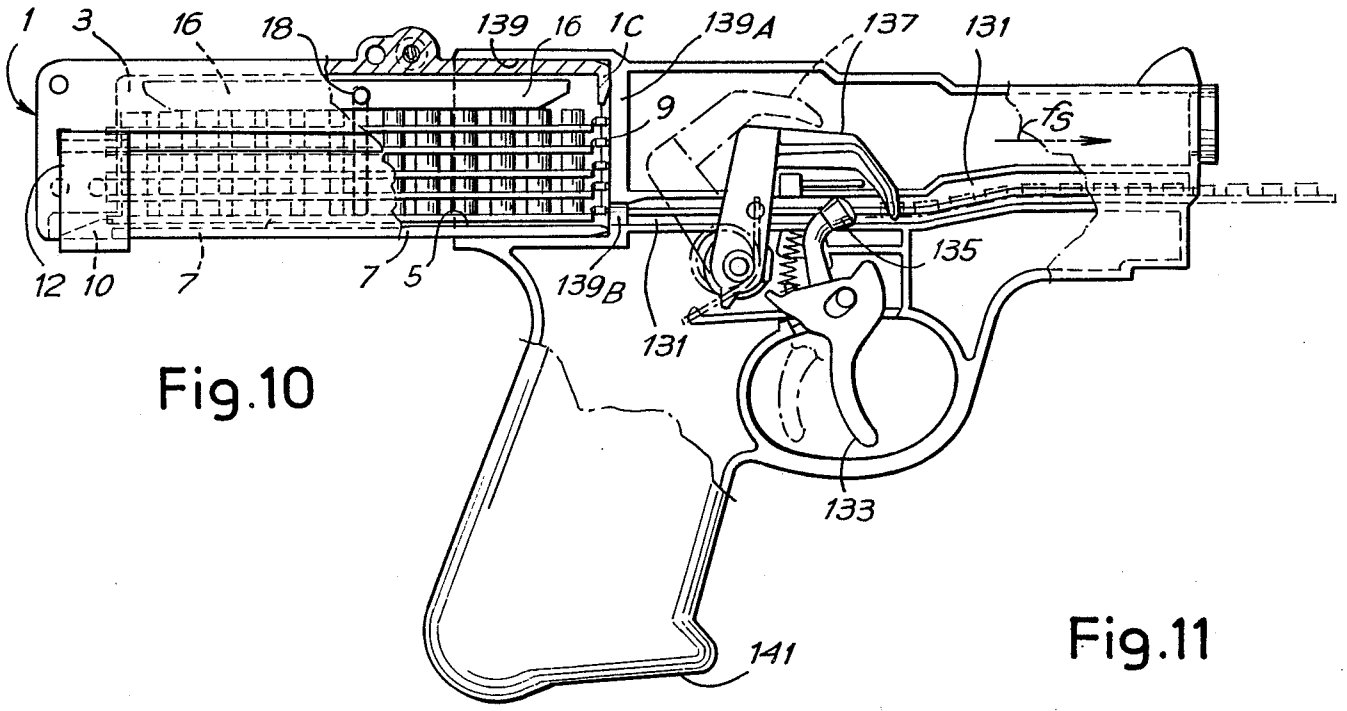
Figure 11:
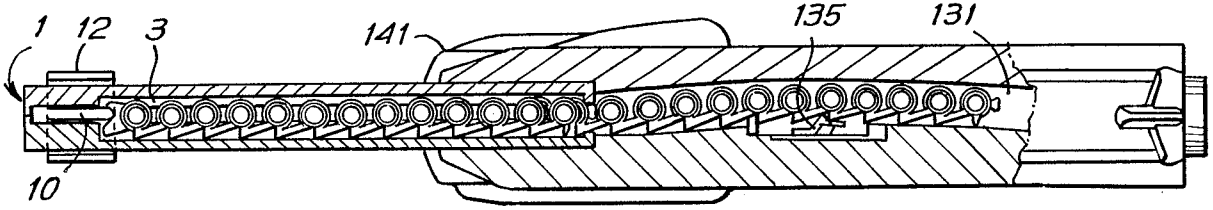

FIGS. 10 to 12 depict a conventional automatic toy firearm, wherein the components corresponding with those in the embodiment illustrated in FIGS. 6 to 9 are indicated by analogous reference numerals augmented by "100". In this version, the cursor 12 is used, which is actuated directly. Additionally, the groove 131 forming the slide housing for the ammunition strip emerges at the front end of the firearm casing instead of at the top. There is no "pump" mechanism for the insertion of each new strip.

It should be understood that the drawings illustrate only one embodiment by way of example, as a practical demonstration of the the invention, which can take the form of a variety of embodiments and arrangements without any departure from the scope of its underlying concept.

I claim:

1. A magazine for strip ammunition for use with a toy firearm, said magazine comprising:

a rectangularly shaped housing for containing a plurality of ammunition strips resting one on top of another, said plurality of strips characterized by a top portion and a bottom portion when loaded in the housing, said housing having a bottom sliding surface along which a strip ammunition is caused to slide during discharge, a discharge aperture located at the bottom of said housing and aligned with said sliding surface through which strip ammunition is slidingly discharged, pressure applying means located in said housing for applying pressure to the top portion of said plurality of strips to prop said strips against said sliding surface, said sliding surface having a slotted opening therealong extending to said aperture, and an extraction device cooperably and slidingly associated with said slotted opening along said sliding surface which when actuated to move from its home position toward said aperture along said opening will cause a strip to discharge through said aperture, said extraction device being characterized in that, when returned to home position in the opposite direction of discharge, it does not drag a strip along with it.

2. The magazine according to claim 1, wherein the pressure device is an elongated rod weight resting on the strips and which is guided by means of pins on said rod which extend into grooved guides inside the housing at right angles to the strips so that it is displaced every time a strip is extracted.

3. The magazine according to claim 1, wherein the pressure device is a flat spring.

4. The magazine according to claim 1, wherein the extraction device exhibits a detent with a thrusting edge at right angles to the sliding surface, and with a sloping back for sliding under the strip in the opposite direction.

5. The magazine according to claim 1, wherein the housing has such a shape as makes it engagable in a toy firearm, with apertures suitable for the insertion and extraction of the ammunition strips and aligned for feeding the ammunition strips into the toy firearm by slide action whenever the trigger is pulled.

6. The magazine according to claim 1, wherein the extraction device is in the form of an externally guided and maneuverable cursor.

7. The magazine according to claim 1, wherein the extraction device is engaged by a rod which is of one piece with moveable grip handle of a pump-type toy firearm.

8. A toy firearm of the automatic type and a magazine therefor, said firearm being shaped for accommodating a stack of strip ammunition enclosed in said magazine, said magazine comprising:

(a) a rectangularly shaped housing having a bottom sliding surface and apertures suitable for insertion and extraction of ammunition strips;

(b) an externally maneuverable extraction device located at a home position in said firearm cooperating with said housing for sliding one strip at a time along the bottom sliding surface of the housing through a housing exit aperture onto a trigger-operated firing-pin; and (c) an internally located pressure applying member in said housing for propping the ammunition strips against the bottom sliding surface of the housing; the magazine providing the toy firearm with compact means for convenient loading, storing and discharging of strip ammunition.

9. A toy firearm as in claim 8, wherein said firearm is of a pump type shaped for accommodating the strip ammunition magazine.

10. The toy firearm according to claim 8, wherein the housing comprises two half-shells which enclose the ammunition stack and the pressure applying member.

11. The toy firearm according to claim 8, wherein the apertures comprise a longitudinal opening in the bottom side and the exit side of the strip ammunition housing.

12. The toy firearm according to claim 8, wherein the strip extraction device comprises a detent with an upright side suitable for pushing the strips out of the magazine and with a sloping back side for returning the device back to the home position without interfering with the stacked alignment of the ammunition strips.

13. The toy firearm according to claim 8, wherein the extraction device is actuated by a trigger assembly cooperating with said toy firearm.

14. The toy firearm according to claim 8, wherein the firearm is a pump action firearm, and wherein the extraction device is actuated by a connecting rod which cooperates with pump means associated with said firearm.

* * * * *